US010276090B2

(12) United States Patent
Park et al.

(10) Patent No.: US 10,276,090 B2
(45) Date of Patent: Apr. 30, 2019

(54) DISPLAY DEVICE CAPABLE OF CORRECTING VOLTAGE DROP AND METHOD FOR DRIVING THE SAME

(71) Applicant: SAMSUNG DISPLAY CO., LTD., Yongin-si, Gyeonggi-do (KR)

(72) Inventors: Hee-Sook Park, Siheung-si (KR); Ji-Hye Eom, Hwaseong-si (KR); Sun-Joon Hwang, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 165 days.

(21) Appl. No.: 14/547,054

(22) Filed: Nov. 18, 2014

(65) Prior Publication Data

US 2015/0255019 A1 Sep. 10, 2015

(30) Foreign Application Priority Data

Mar. 5, 2014 (KR) ..... 10-2014-0025916

(51) Int. Cl.
*G09G 3/3225* (2016.01)

(52) U.S. Cl.
CPC ... *G09G 3/3225* (2013.01); *G09G 2320/0223* (2013.01); *G09G 2320/0233* (2013.01); *G09G 2320/0285* (2013.01); *G09G 2330/00* (2013.01); *G09G 2360/16* (2013.01)

(58) Field of Classification Search
None
See application file for complete search history.

(56) References Cited

U.S. PATENT DOCUMENTS 5,398,076 A * 3/1995 Lum ..... H04N 5/202 348/675
2005/0017989 A1* 1/2005 Huang ..... G09G 5/006 345/690
2006/0007239 A1* 1/2006 Harrison ..... G09G 5/02 345/590

(Continued)

FOREIGN PATENT DOCUMENTS

JP 2003-280590 A 10/2003
KR 10-2008-0070381 A 7/2008

(Continued)

*Primary Examiner* — Matthew Yeung
(74) *Attorney, Agent, or Firm* — Lewis Roca Rothgerber Christie LLP

(57) ABSTRACT

An organic light emitting display device includes: a display panel including a plurality of pixels; a controller configured to correct input image signals supplied from the outside according to an amount of voltage drop; a data driver configured to supply data signals corresponding to the corrected image signals; and a scan driver configured to supply scan signals to scan lines. The controller includes: a load factor calculator configured to calculate a load factor of a panel; a horizontal block load factor calculator configured to calculate a driving current of a plurality of horizontal blocks formed by dividing the panel according to the scan lines; a voltage drop amount calculator configured to calculate the amount of the voltage drop based on the driving current; and a lookup table generator configured to generate a voltage drop correction lookup table based on the amount of the voltage drop.

18 Claims, 9 Drawing Sheets

(56) References Cited

U.S. PATENT DOCUMENTS

| | | | | |
|---|---|---|---|---|
| 2006/0044237 | A1* | 3/2006 | Lee | G09G 3/3233 345/82 |
| 2008/0180364 | A1 | 7/2008 | Kim | |
| 2009/0147110 | A1* | 6/2009 | Muramatsu | H04N 5/3572 348/255 |
| 2010/0149162 | A1 | 6/2010 | Park et al. | |
| 2010/0171774 | A1* | 7/2010 | Mizukoshi | G09G 3/3275 345/690 |
| 2011/0018787 | A1* | 1/2011 | Nakamura | G09G 3/3233 345/76 |
| 2012/0019506 | A1* | 1/2012 | Hekstra | G09G 3/3233 345/212 |
| 2012/0026207 | A1* | 2/2012 | Komiya | G09G 3/3233 345/690 |
| 2014/0062989 | A1* | 3/2014 | Ebisuno | G09G 3/3241 345/212 |
| 2016/0055791 | A1* | 2/2016 | Kishi | G09G 3/3241 345/212 |

FOREIGN PATENT DOCUMENTS

| | | | |
|---|---|---|---|
| KR | 10-2010-0014106 | A | 2/2010 |
| KR | 10-2010-0068075 | A | 6/2010 |
| KR | 10-2011-0123952 | A | 11/2011 |

* cited by examiner

DISPLAY DEVICE CAPABLE OF CORRECTING VOLTAGE DROP AND METHOD FOR DRIVING THE SAME

CROSS-REFERENCE TO RELATED APPLICATION

This application claims priority to and the benefit of Korean Patent Application No. 10-2014-0025916, filed on Mar. 5, 2014, with the Korean Intellectual Property Office, the disclosure of which is incorporated herein in its entirety by reference.

BACKGROUND

1. Field

Aspects of embodiments of the present invention relate to a display device capable of correcting image signals in order to improve luminance variation caused by a voltage drop depending on display patterns of the screen and a driving method thereof.

2. Description of the Related Art

In general, a display device includes a plurality of pixels provided in an area defined by a black matrix or a pixel defining layer. The display device is categorized into a liquid crystal display (LCD), a plasma display panel (PDP), an organic light emitting display (e.g., an organic light emitting diode (OLED) display), and the like.

As examples of methods for driving the organic light emitting display, there are a sequential driving method of receiving data signals in response to scan signals sequentially applied to the plurality of pixels and emitting light from the pixels in order of the data signals received, and a digital driving method of receiving the data signals for one frame and emitting light from all the pixels simultaneously.

The display device includes a data driving unit for supplying data signals to each of the plurality of pixels. The recent trend of large-sized and high-resolution display devices require more pixels, and power lines for applying power to each pixel is therefore reduced in width and increased in length, thereby increasing resistance of the power lines.

The voltage drop caused by the increased resistance produces voltage variation of a driving power between pixels adjacent to the power lines and pixels spaced apart from the power lines. This voltage variation leads to non-uniform luminance depending on the distance from the power lines In addition, depending on load centrality and display location of a displayed image, an amount of voltage drop varies, although images have the same load factor. Therefore, a method of predicting the voltage drop depending on the display location and the image pattern and correcting image signals accordingly on a real-time basis is desired.

It is to be understood that this background section is intended to provide useful background information for understanding aspects of the present invention and as such, the background section may include aspects, ideas, concepts, and features that are not part of what is known or appreciated by those skilled in the pertinent art prior to the date the present application is filed.

SUMMARY

Aspects of embodiments of the present invention are directed to an organic light emitting display device with high resolution that is improved in luminance uniformity in consideration of display locations of images in a panel and display patterns of images.

According to an embodiment of the present invention, an organic light emitting display device includes: a display panel including a plurality of pixels; a controller configured to correct input image signals supplied from the outside according to an amount of voltage drop, and to output the corrected image signals, the controller including: a load factor calculator configured to calculate a load factor of a panel based on the input image signals; a horizontal block load factor calculator configured to calculate a driving current of a plurality of horizontal blocks formed by dividing the panel according to a plurality of scan lines; a voltage drop amount calculator configured to calculate the amount of the voltage drop based on the driving current; and a lookup table generator configured to generate a voltage drop correction lookup table based on the amount of the voltage drop; a data driver configured to supply data signals corresponding to the corrected image signals to data lines coupled to the pixels; and a scan driver configured to supply scan signals in synchronization with the data signals to the scan lines coupled to the pixels.

The horizontal block load factor calculator may be configured to calculate the load factors of the plurality of horizontal blocks based on the input image signals.

The voltage drop amount calculator may be configured to calculate the voltage drop amounts of the horizontal blocks based on the horizontal block driving current and a line resistance of the panel.

The lookup table generator may be configured to generate the voltage drop correction lookup table based on the voltage drop amounts of the horizontal blocks.

The voltage drop correction lookup table may include luminance correction gain values of the display panel based on the voltage drop amounts of the plurality of horizontal blocks.

The luminance correction gain values of the display panel may be assigned for each scan line.

The controller may further include an image signal corrector configured to correct image signals by multiplying the luminance correction gain values of the voltage drop correction lookup table.

According to an embodiment of the present invention, a method of driving the organic light emitting display device includes: calculating image signal load factors of a plurality of horizontal blocks based on input image signals; calculating driving currents of the horizontal blocks based on the image signal load factors of the horizontal blocks; calculating voltage drop amounts of the horizontal blocks based on the driving currents of the horizontal blocks; calculating voltage drop correction gain values for correcting the input image signals based on the voltage drop amounts of the horizontal blocks; and correcting the input image signals based on the voltage drop correction gain values.

The voltage drop correction gain values may be updated for the input image signals on a frame-by-frame basis.

The voltage drop correction gain values may be assigned for each scan line.

The method may further include generating a voltage drop correction lookup table based on the voltage drop amounts of the horizontal blocks.

The method may further include calculating an image signal load factor of an entire panel based on the input image signals.

According to aspects of embodiments of the present invention, the display device may analyze the display location and the pattern of the image provided from the outside for each horizontal block composed of a plurality of cells, and correct the image signals based on the analyzed data, thereby improving the luminance uniformity of the display panel.

The foregoing summary is illustrative only and is not intended to be in any way limiting. In addition to the aspects, embodiments, and features described above, further aspects, embodiments, and features will become apparent by reference to the drawings and the following detailed description.

BRIEF DESCRIPTION OF THE DRAWINGS

The above and other features and aspects of the present invention will be more clearly understood from the following detailed description taken in conjunction with the accompanying drawings, in which.

DETAILED DESCRIPTION

Figure 1:
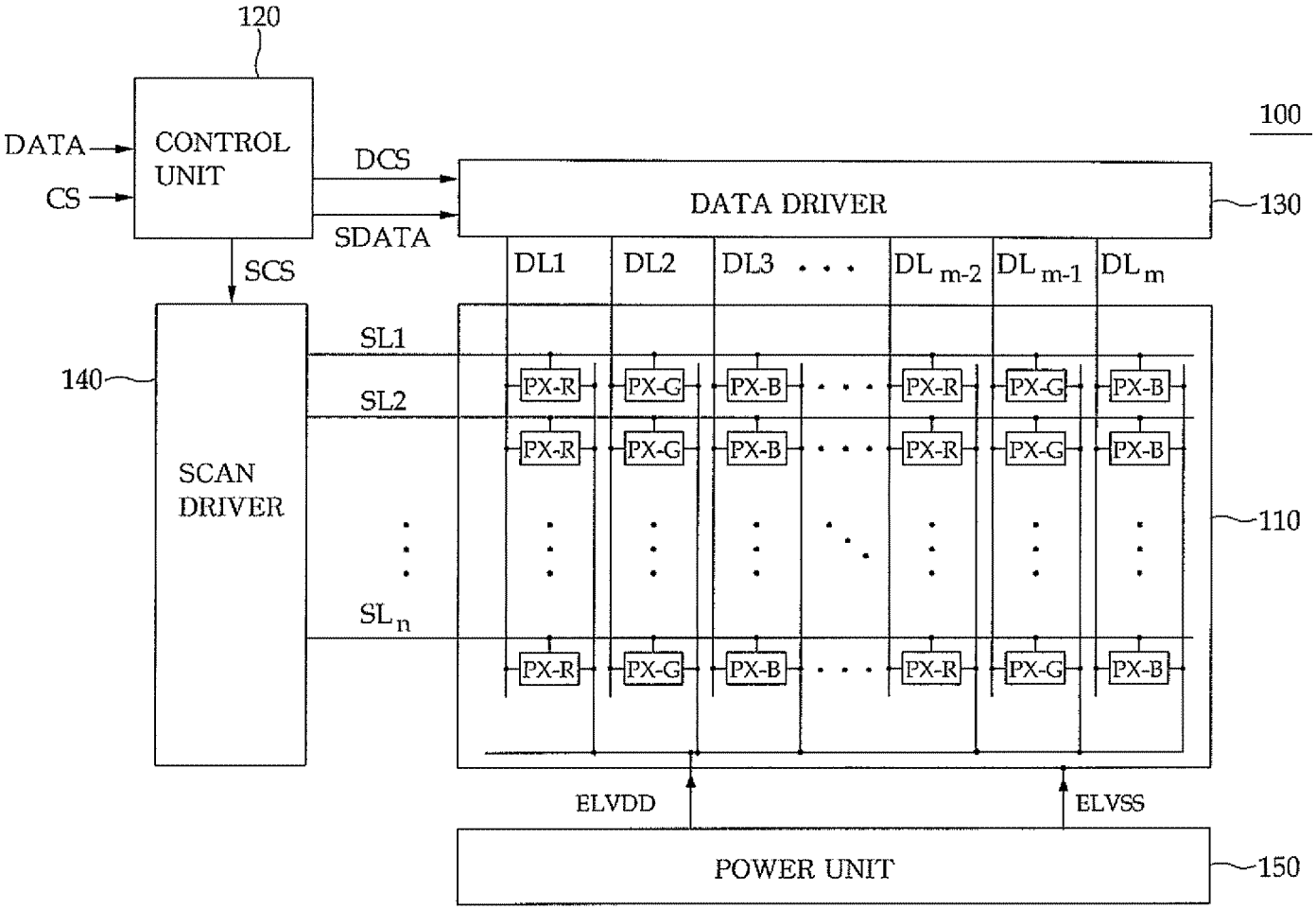
FIG. 1 is a schematic plan view showing a display device according to an embodiment of the present invention.

Hereinafter, embodiments of the present invention will be described in more detail with reference to the accompanying drawings.

Although the present invention has several embodiments and can be modified in various manners, example embodiments are illustrated in the accompanying drawings and will be mainly described in the specification. However, the spirit and scope of the present invention is not limited to the example embodiments described herein, and should be construed as including all the changes, equivalents, and substitutions included within the spirit and scope of the present invention.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" can be termed likewise without departing from the spirit and scope of the present invention. Expressions such as "at least one of," when preceding a list of elements, modify the entire list of elements and do not modify the individual elements of the list. Further, the use of "may" when describing embodiments of the present invention refers to "one or more embodiments of the present invention."

When an element is described as "coupled" or "connected" to another element, the element may be "directly coupled" or "directly connected" to the other element, or "indirectly coupled" or "indirectly connected" to the other element through one or more intervening elements. In this specification, the description of some parts which are not necessary for a complete understanding of the present invention have been omitted, and like reference numerals refer to like elements throughout the specification.

FIG. 1 is a schematic plan view showing a display device according to an embodiment of the present invention.

Referring to FIG. 1, an organic light emitting display 100 includes a display panel 110 including a plurality of pixels, a data driver 130 for applying data signals to pixel circuits of the plurality of pixels over data lines, a scan driver 140 for applying scan signals to the pixel circuits, a power unit 150 for applying a driving power to the organic light emitting diodes OLEDs of the pixels, and a control unit 120 (e.g., a controller) for controlling the data driver 130, the scan driver 140, and the power unit 150.

Further, the display device 100 may further include the power unit 150 on the display panel 110 in order to provide a driving power ELVDD and power ground ELVSS.

The display panel 110 includes a plurality of scan lines SL1~SLn extended in a row direction for applying scan signals, a plurality of data lines DL1~DLm extended in a column direction, and a plurality of pixels PX arranged in a matrix form at crossing regions of the scan lines SL1~SLn and the data lines DL1~DLm. The driving power ELVDD and the power ground ELVSS are supplied to the plurality of pixels PX from the power unit 150, and the scan signals and the data signals are provided to the pixels PX over the scan lines SL1~SLn and the data lines DL1~DLm, respectively.

FIG. 1 illustrates a single bank structure where the driving power ELVDD is applied to only one side of the display panel. However, in a case of a large-sized panel, voltage drops occur depending on the length of the power lines. Therefore, a dual bank structure may be used, where panels are divided into two parts, and power is supplied to both sides of the panel.

Each of the pixels PX provided in the display panel 110 includes the organic light emitting diode OLED. In a case where the driving power ELVDD and the power ground ELVSS are supplied, current flows through the OLED, and thus light is emitted. However, the present invention is not limited thereto. Thus, the display panel 110 may be other types of display panels including a self light-emitting element.

The display panel 110 may be driven by a digital driving method. When the digital driving method is used, gray-scale level is expressed by adjusting emitting time of each pixel PX in accordance with the data signals. The pixels PX emit light by the supplied driving power ELVDD and power ground ELVSS. In this case, the emitting time is adjusted in accordance with the data signals in order to express the gray-scale level.

In a case where the digital driving method is used, an amount of the driving power ELVDD applied to the pixels PX and an amount of the current flowing to the power ground ELVSS for a unit time are concentrated, such that the voltage drop becomes larger, thereby resulting in substantially non-uniform luminance compared to the analog driving method, although the same gray-scale level is expressed.

The control unit 120 controls the data driver 130, the scan driver 140, and the power unit 150. The control unit 120 is configured to generate signals for controlling the data driver 130, the scan driver 140, and the power unit 150 based on image signals DATA and control signals CS provided from the outside. The control unit 120 transmits the generated signals to the data driver 130, the scan driver 140, and the power unit 150.

For example, the control signals CS may include timing signals, such as vertical synchronization signals Vsync and horizontal synchronization signals Hsync, clock signals CLK, and data enable signals DE. The image signals DATA may include digital signals expressing gray-scale levels for light that is emitted from the pixels PX.

The data driver 130 receives data control signals DCS and scaled image signals from the control unit 120, and supplies data signals corresponding to the scaled image signals to the pixels PX over data lines DL1~DLm in response to the data control signals DCS.

The scan driver 140 receives scan control signals SCS from the control unit 120, and generates the scan signals. Further, the scan driver 140 may transmit the generated scan signals to the pixels PX over the scan lines SL1~SLn. The pixels PX of each row are sequentially selected in response to the scan signals, and the data signals may be provided thereto.

The power unit 150 generates the driving power ELVDD and the power ground ELVSS, and applies the generated powers to the display panel 110. The driving power ELVDD and the power ground ELVSS are applied to the plurality of pixels PX of the display panel 110, such that the pixels PX can emit light. An amount of current flowing through the pixels PX during an emission period can be determined in accordance with the voltage value of the driving power ELVDD and the power ground ELVSS. Provided that the pixels PX emit light, and that the amount of current flowing through the pixels PX, for example the driving current, is changed, luminance may be changed, although the same gray-scale level is displayed.

A single bank structure is illustrated in FIG. 1, where the power unit is disposed only at the bottom portion of the display device. However, the dual bank structure (e.g., refer to FIG. 3) may also be used, where two power units are disposed respectively at the upper and bottom portions of the display device, in order to reduce the length of the power lines between the pixels PX and the power units, such that the voltage drop can be reduced.

Figure 2:
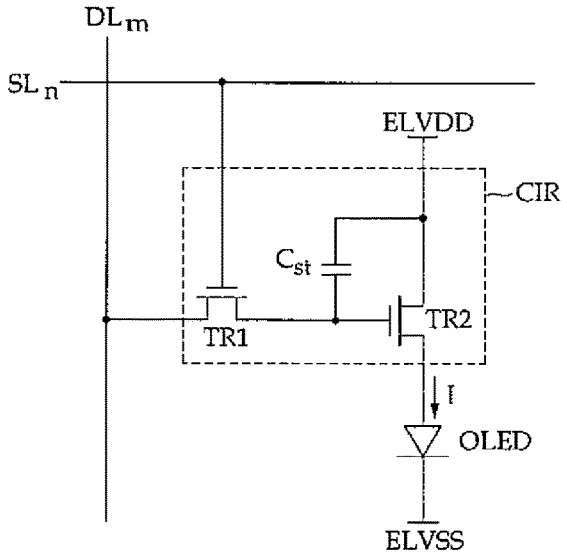
FIG. 2 is a circuit diagram showing a pixel circuit of a display device according to an embodiment of the present invention.

FIG. 2 is a circuit diagram showing a pixel circuit of a display device according to an embodiment of the present invention. In more detail, FIG. 2 illustrates a pixel circuit of an organic light emitting display. For ease of description, a pixel circuit connected to the data line DLm and the scan line SLn is illustrated.

Referring to FIG. 2, the pixels PX may include the organic light emitting diode OLED and the pixel circuit CIR for supplying current to the organic light emitting diode OLED. The pixel circuit CIR may include a plurality of transistors TR1 and TR2, and a capacitor Cst. The plurality of transistors TR1 and TR2 may be thin film transistors TFT. In FIG. 2, the pixel circuit CIR is described as having two transistors TR1 and TR2 and one capacitor Cst. However, the present invention is not limited thereto. Thus, the pixel circuit CIR may have various configurations to supply current to the organic light emitting diode in accordance with the data signals.

An anode electrode of the organic light emitting diode OLED is connected to the pixel circuit CIR, and a cathode electrode is connected to the power ground ELVSS. Such organic light emitting diodes OLEDs generate light corresponding to the current supplied from the pixel circuit CIR.

When the scan signal is applied to the scan line SLn, the pixel circuit CIR is supplied with the data signal from the data line DLm. In a case where the scan signal is supplied to the scan line SLn, the first transistor TR1 is turned on. In a case where the data signal is applied to a gate electrode of the second transistor TR2 over the data line DLm and through the first transistor TR1, the data signal controls the turn-on/turn-off of the second transistor TR2. In a case where the second transistor TR2 is turned on in response to the data signal, the driving power ELVDD is applied to the anode electrode of the organic light emitting diode OLED, and thus, current I flows through the organic light emitting diode OLED. Accordingly, the organic light emitting diode OLED emits light. In this case, an amount of the current I may vary depending on the voltage applied to both end portions of the organic light emitting diode OLED, that is, depending on voltage values of the driving power ELVDD and the power ground ELVSS. In a case where the second transistor TR2 is turned off, the anode electrode of the OLED floats, such that light becomes extinct in the organic light emitting diode OLED. Meanwhile, the capacitor Cst stores a voltage corresponding to the voltage difference between the driving power ELVDD and the applied data signal, such that the second transistor TR2 can maintain a state of turn-on or turn-off, although the first transistor TR1 is turned off and the data signals are not applied.

The luminance of the light emitted from the pixels PX is determined by emitting time of the pixel PX, for example, emitting time of the organic light emitting diode OLED and an amount of the current I during the emission period. As the emitting time of the pixel PX in one frame period is lengthened and a current value proportional to a voltage value of the driving power ELVDD increases, the luminance of light emitted from the pixel PX is increased.

Figure 3:
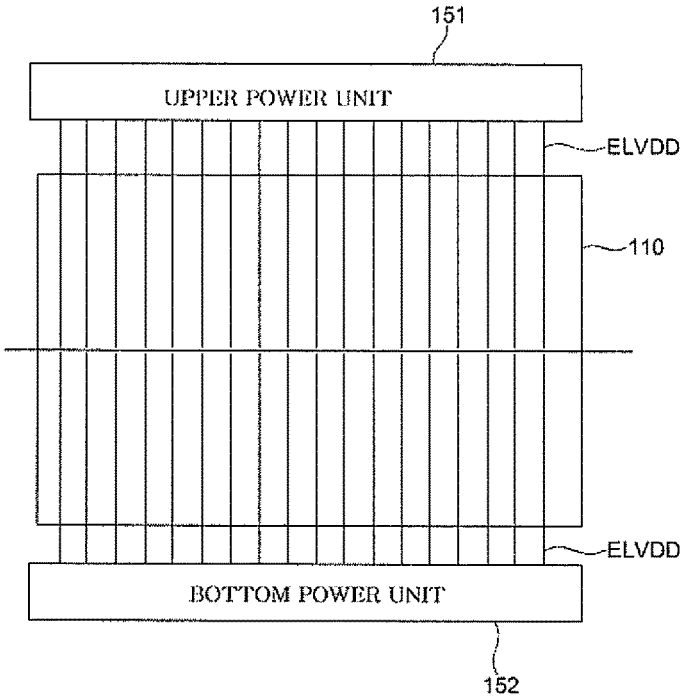
FIG. 3 is a schematic diagram illustrating a dual-bank type display panel.

FIG. 3 is a schematic diagram illustrating a dual-bank type display panel according to an embodiment of the present invention.

Referring to FIG. 3, the upper power unit 151 and the bottom power unit 152 apply the driving power ELVDD to the upper and the bottom portions of the display panel 110 over divided power lines, respectively. The dual bank structure where the driving power ELVDD is applied to the both sides of the panel is desirable over the single bank structure where the driving power ELVDD is applied to one side of the panel, in that the power supplying lines are reduced to half the length, such that resistance is reduced and the voltage drop (i.e., IR DROP) can be further reduced. However, although the power lines are reduced in length, the voltage drop IR DROP occurs when a large proportion of the pixels emit light to display an image, because the driving current supplied to the panel becomes large.

In addition, in the dual bank panel illustrated in FIG. 3, luminance deterioration and color coordinates distortion occur in a center portion of the display panel where the end portions of the power lines are located. The center portion of the panel is a center area of a screen, and thus a user can easily recognize the luminance distortion when the user watches the image.

In order to improve the luminance non-uniformity and the color coordinates distortion caused by the voltage drop IR DROP, input images can be corrected by using a lookup table. That is, the image signals are corrected depending on the pixel location in the panel based on the panel load factors of the image signals. According to an existing driving method, the same lookup table is applied to correct the image signals, although the image signals have different panel load factors, and thus, it is difficult to make a desirable correction in accordance with the amount of voltage drop changed depending on the display location or the display pattern of the image signals.

Hereinafter, a method of correcting image information by using the existing fixed lookup table will be described in detail with reference to FIGS. 4A through 5B.

Figure 4A:
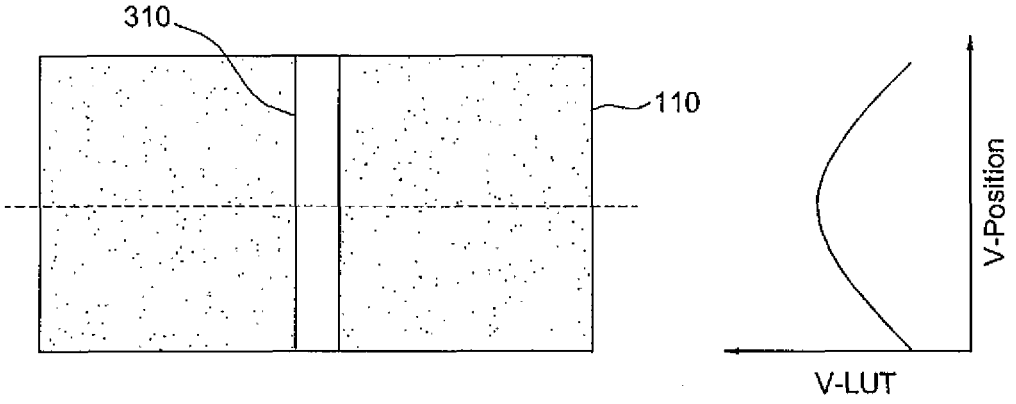
FIGS. 4A and 4B are mimetic diagrams illustrating a method of correcting a voltage drop based on display patterns by using an existing fixed lookup table.
Figure 4B:
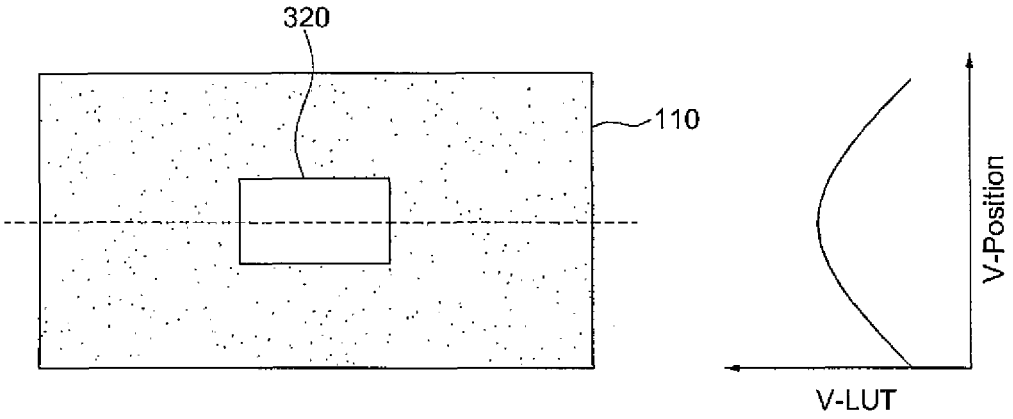

FIGS. 4A and 4B are mimetic diagrams illustrating a method of correcting a voltage drop based on display patterns by using an existing fixed lookup table.

FIGS. 4A and 4B illustrate a white quadrilateral pattern with long vertical sides 310, and a white quadrilateral pattern with long horizontal sides 320 displayed on the display panel 110, respectively. The power lines are extended only to a dashed line at the center of the panel, and thus the amount of voltage drop becomes the largest at the dashed line in the drawings.

Graphs defining a relationship between the location of power lines (vertical position in the display panel) and gain values are illustrated on the right side of FIGS. 4A and 4B. Thus, image signals can be corrected depending on the location of power lines in accordance with the graphs.

Referring to FIGS. 4A and 4B, in the voltage drop correction lookup table V_LUT, higher gain correction values are assigned to the center area in the vertical position V-Position, such that luminance level can be increased. In this case, the voltage drops caused by the power lines are corrected all together by the gain correction values in the fixed lookup table.

In other words, according to the existing method of correcting a voltage drop, the image signals are corrected based on the load factors of the image information on a frame-by-frame basis. However, although images have the same load factor, the images may have different amounts of voltage drops depending on the displayed image pattern, and therefore, it is not desirable to apply the same gain correction values in the fixed lookup table to all the image signals.

In a case where image signals having the same load factors are corrected based on the same fixed lookup table, the voltage drop has a large effect on the vertical pattern 310 compared to the horizontal pattern 320.

The voltage drop is proportional to a multiplication of resistance of the power line by current flowing through the power line. The power line has an eigenvalue of the resistance depending on materials and forms used in the manufacturing process of the display panel.

On the other hand, the current flowing through the power line is determined depending on whether the pixels connected to the power line emit light or not. The white vertical pattern 310 refers to a pattern where all the pixels connected to at least one power line emit light. On the contrary, the white horizontal pattern 320 refers to a pattern where about 20~30% of the pixels connected to at least one power line emit light.

In a case where the vertical pattern 310 is displayed, an amount of current flowing through one power line becomes large compared to the horizontal pattern 320, and thus, if the voltage drop correction lookup table based on an overall load factor is applied, the vertical pattern 310 has a dim luminance condition compared to the horizontal pattern 320, although the two patterns have the same gray-scale level and the same area.

Figure 5A:
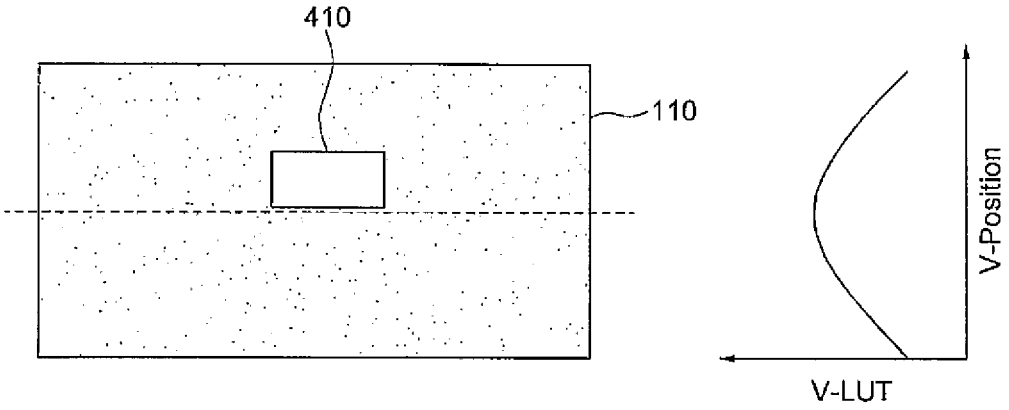
FIGS. 5A and 5B are mimetic diagrams illustrating a method of correcting a voltage drop based on display locations by using the existing fixed lookup table.
Figure 5B:
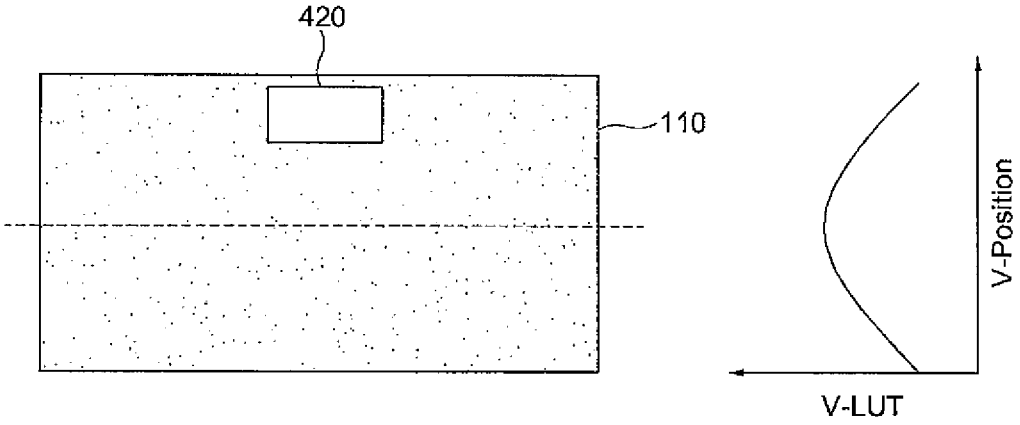

FIGS. 5A and 5B are mimetic diagrams illustrating a method of correcting a voltage drop based on display locations by using an existing fixed lookup table.

In more detail, FIG. 5A illustrates a horizontal quadrilateral pattern in the bottom portion 410 located farthest from inlets of the power lines, and FIG. 5B illustrates the horizontal quadrilateral pattern in the upper portion 420 having the same gray-scale level and the same shape as the horizontal quadrilateral pattern in the bottom portion 410 and located adjacent to the inlets of the power lines.

Referring to FIGS. 5A and 5B, in a case where the same fixed lookup table is applied to display the bottom pattern 410 and the upper pattern 420, different luminance levels may be observed, although the gray-scale level and the load factors are the same.

In other words, in a case where the bottom pattern 410 is displayed, current required for emitting light flows from the inlets of the power lines to the pixels of the pattern, thereby exhibiting substantial luminance deterioration due to the voltage drop. On the contrary, in a case where the upper pattern 420 is displayed, the resistance of the power lines has little effect on power supply, and thus the luminance deterioration caused by the voltage drop is not often observed.

Figure 6:
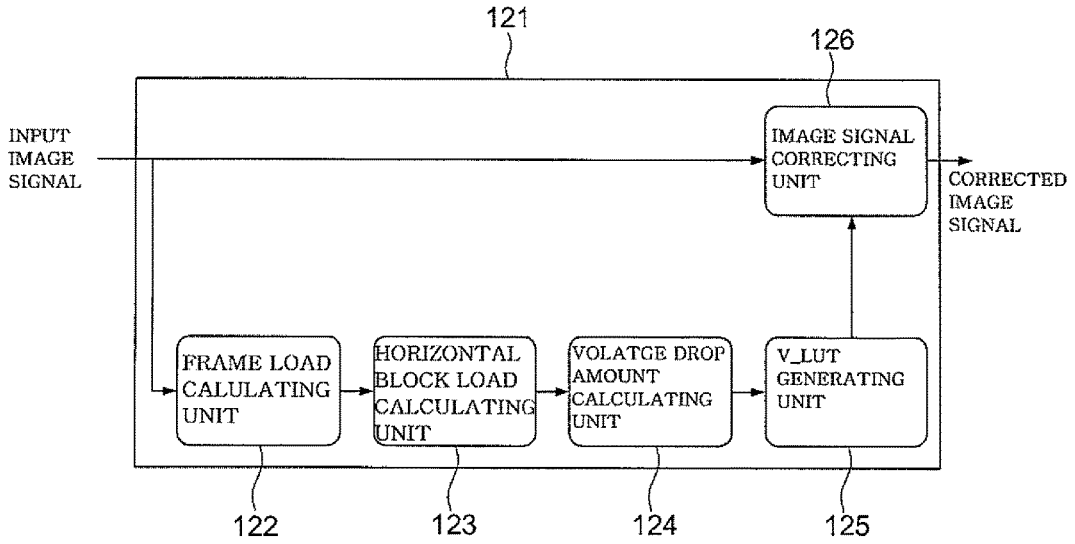
FIG. 6 is a block diagram illustrating a voltage drop correcting unit according to an embodiment of the present invention.

FIG. 6 is a block diagram illustrating a voltage drop correcting unit according to an embodiment of the present invention.

According to an embodiment of the present invention, the control unit (e.g., controller) may include the voltage drop correcting unit (e.g., voltage drop corrector).

Referring to FIG. 6, the voltage drop correcting unit 121 includes a frame load calculating unit 122 (e.g., a frame load calculator) for calculating load factors of the image information supplied from the outside, a horizontal block load calculating unit 123 (e.g., a horizontal block load calculator) for calculating a load factor of each horizontal block of the image information, a voltage drop amount calculating unit 124 (e.g., a voltage drop amount calculator) for calculating an amount of voltage drop based on the horizontal block load, a lookup table V_LUT generating unit 125 (e.g., a V_LUT generator) for generating a voltage drop correction lookup table based on the calculated voltage drop amount, and an image signal correcting unit (e.g., an image signal corrector) for correcting the image information based on the gain values of the voltage drop correction lookup table.

The voltage drop correction unit 121 of FIG. 6 is configured to correct the input image signal based on a lookup table in order to improve luminance deterioration caused by a voltage drop.

The frame load calculating unit 122 is configured to analyze an input image signal on a frame-by-frame basis, and to calculate an overall load factor. The load factor of the image signal is the sum of the image data values of one frame. For example, color image information having 1920×1080 resolution contains all of the three color image information, and 1 frame, therefore, contains image gray-scale information of 1920×1080×3=6,220,800. Provided that each pixel can express 256 gray levels, the maximum load value of the image information becomes as follows. 1920×1080×3×256=1,592,524,800.

In this case, the maximum load value refers to an image data value with 100% load factor, on condition that all the pixels of the display panel display a white image having the maximum gray-scale level. In this case, the load factor refers to a ratio of a load value corresponding to an image data value to a 100% load value in terms of percentages.

In the foregoing description, the load factor is calculated by adding all the gray-scale values. However, the present invention is not limited thereto, and thus the load factor may be determined by other methods, such as using the most significant bits in order to make the best use of an arithmetic processor.

In addition, the frame load calculating unit 122 is configured to calculate a frame driving current value required for a whole panel based on the calculated load factor of the image frame. The frame driving current is a calculated current consumption corresponding to an input image signal in consideration of characteristics of the panel.

The horizontal block load calculating unit 123 is configured to divide the display panel into a plurality of horizontal blocks with respect to a plurality of scan lines, and to calculate a load factor of each horizontal block.

Recent display devices include high-resolution panels, and thus, if image information is corrected based on image information of all the pixels on a real-time basis, an amount of data to be processed becomes so large that a high-priced arithmetic processor is required.

On the other hand, according to an embodiment of the present invention, the voltage drop correction unit processes data for each horizontal block divided by a plurality of scan lines, such that load on the arithmetic processor can be reduced. Because an amount of data is reduced, the voltage drop correction lookup table can be updated for each image frame, such that voltage drop correction errors can be minimized or reduced even for dynamic images.

The voltage drops occur depending on the location of image information, rather than an individual pixel, and thus analysis on the plurality of pixel blocks, instead of the individual pixel, can also lead to a reliable result.

According to an embodiment of the present invention, it is assumed that the panel area is divided into 12 horizontal blocks. However, the number of the horizontal blocks is not limited thereto.

A load factor of each horizontal block is a ratio of the load factor of each horizontal block to a load factor of a whole screen. Further, a driving current for each horizontal block can be calculated based on the frame driving current calculated from the frame load calculating unit in accordance with the load factor of each horizontal block.

The horizontal block load calculating unit 123 is configured to calculate driving current values of I1, I2, I3, I4, I5, I6, I7, I8, I9, I10, I11, I12 for the 12 horizontal blocks on a frame-by-frame basis, and to output the result to the voltage drop amount calculating unit 124.

The voltage drop amount calculating unit 124 is configured to calculate an amount of voltage drop caused when the horizontal black driving current is applied over the power lines. The voltage drop amount calculating unit 124 calculates the amount of voltage drop across the power line based on the driving current value for each horizontal block. In a case where the voltage drop amount calculating unit 124 calculates the voltage drop amount based on each horizontal block driving current, driving current of horizontal blocks disposed at the end of the power lines are taken into consideration depending on the location of the horizontal blocks. In this case, as the horizontal block is located farther from the power line inlets, the voltage drop between the voltage at the power line inlet and the voltage applied at each horizontal block becomes larger.

The V_LUT generating unit 125 is supplied with the voltage drop value calculated by the voltage drop amount calculating unit 124, and generates the voltage drop correction lookup table V_LUT.

Thus, gain correction values are adjusted in order to correct decreased luminance of the display panel, in accordance with the voltage drops of the horizontal blocks updated on a frame-by-frame basis.

The V_LUT generating unit 125 generates the voltage drop lookup table V_LUT based on the input voltage drop amount of each horizontal block and deviation between blocks. In this case, the 12 voltage drop amount values are provided, such that 12 correction data can be generated accordingly. The correction data is determined in consideration of the amount of voltage drop depending on the location of the horizontal blocks and the deviation of voltage drop between the horizontal blocks.

The V_LUT generating unit 125 generates gain correction values corresponding to each scan line based on the 12 correction data by using data interpolation, such that the gain correction values can be applied to all the pixels in the display panel. The data interpolation is a data processing method of constructing continuous data based on a discrete set of known data points, and has various types including linear interpolation, polynomial interpolation, and spline interpolation, and thus, a desirable interpolation method can be employed depending on the characteristics of the panel and the number of horizontal blocks.

The image signal correcting unit 126 is configured to correct gray values of the image signals for each pixel by multiplying the input image signal by the gain value of the voltage drop correction lookup table V_LUT corresponding to the vertical position of the pixel.

Figure 7A:
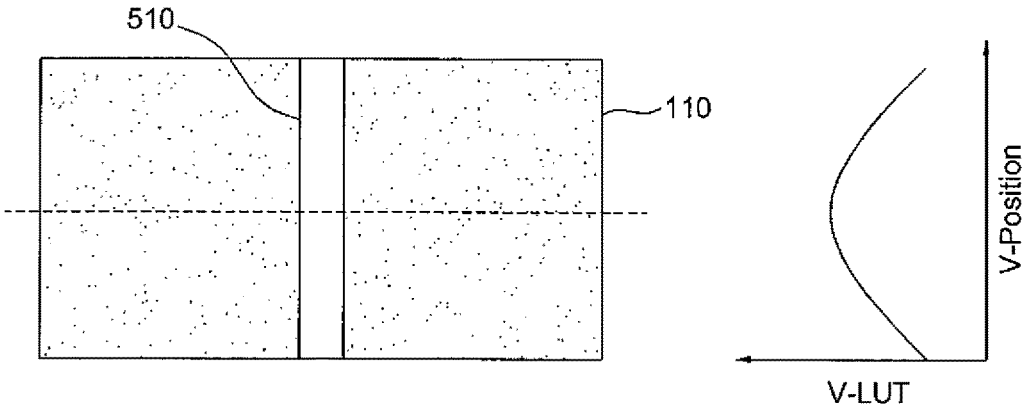
FIGS. 7A and 7B are mimetic diagrams illustrating a method of correcting a voltage drop based on display patterns by using a lookup table according to an embodiment of the present invention.
Figure 7B:
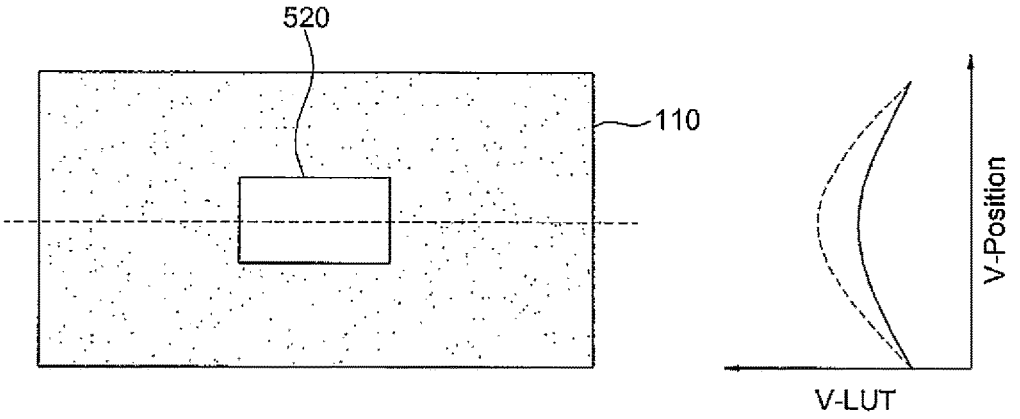

FIGS. 7A and 7B are mimetic diagrams illustrating a method of correcting a voltage drop depending on display patterns by applying a voltage drop lookup table according to an embodiment of the present invention.

Referring to FIG. 7A, a quadrilateral pattern with long vertical sides 510 is displayed on the display panel 110. In a case where the vertical pattern 510 is displayed, driving current is applied to all the pixels in the vertical direction, such that a substantial voltage drop occurs across the power lines. In this case, gain correction values of the voltage drop correction lookup table V_LUT are adjusted to become larger, and the image signals are corrected accordingly to prevent or reduce the luminance deterioration at end portions of the power lines.

On the contrary, referring to FIG. 7B, in a case where a horizontal pattern 520 having the same gray-scale level and the same area as the vertical pattern 510 is displayed, only part of the pixels of the power lines emit light, and thus the voltage drop amount becomes small compared to the vertical pattern 510. In this case, gain correction values of the voltage drop correction lookup table V_LUT are adjusted to become smaller compared to the vertical pattern to correct image signals.

Figure 8A:
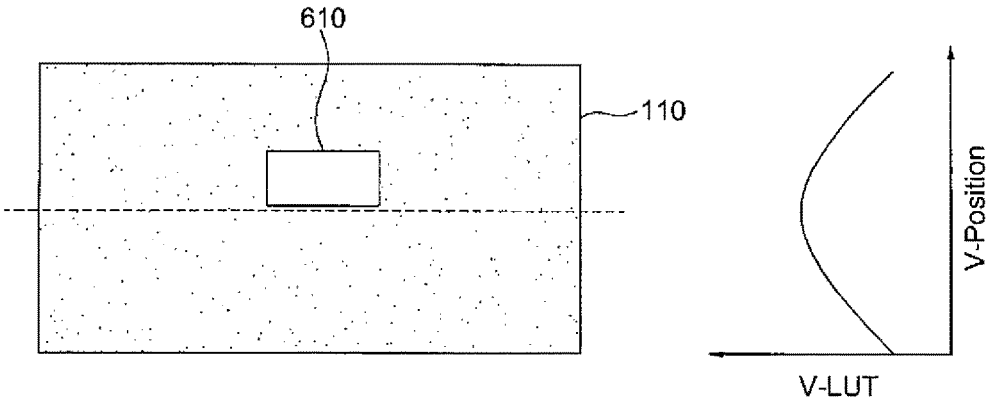
FIGS. 8A and 8B are mimetic diagrams illustrating a method of correcting a voltage drop based on display locations by using a lookup table according to an embodiment of the present invention.
Figure 8B:
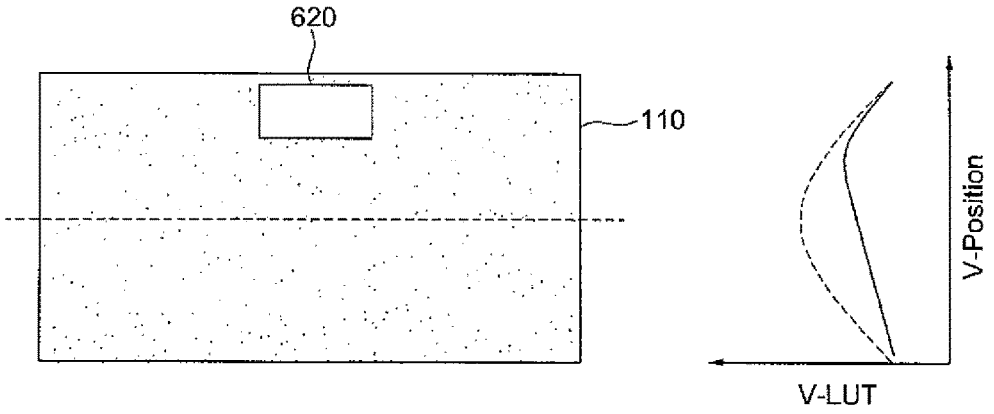

FIGS. 8*a* and 8*b* are mimetic diagrams illustrating a method of correcting a voltage drop based on display locations by using a lookup table according to an embodiment of the present invention.

In more detail, FIG. 8A illustrates a horizontal quadrilateral pattern in the bottom portion 610 located farthest from the inlets of the power lines, and FIG. 8B illustrates the horizontal quadrilateral pattern in the upper portion 620 having the same gray-scale level and the same shape as the horizontal quadrilateral pattern in the bottom portion 610.

In a case where the bottom pattern 610 is displayed, current required for emitting light flows from the inlets of the power lines to the pixels of the pattern, thereby exhibiting substantial luminance deterioration due to the voltage drop. On the contrary, in a case where the upper pattern 620 is displayed, the resistance of the power lines has little effect on power supply, and thus the luminance deterioration caused by the voltage drop is not often observed.

Thus, as illustrated in FIG. 8A, when the bottom pattern 610 is displayed, the voltage drop correcting unit 121 adjusts gain correction values of the voltage drop correction lookup table V_LUT to become larger to correct the image signals.

In addition, as illustrated in FIG. 8B, when the upper pattern 620 is displayed, the voltage drop correcting unit 121 adjusts gain correction values of the voltage drop correction lookup table V_LUT to become smaller to correct the image signals.

Figure 9:
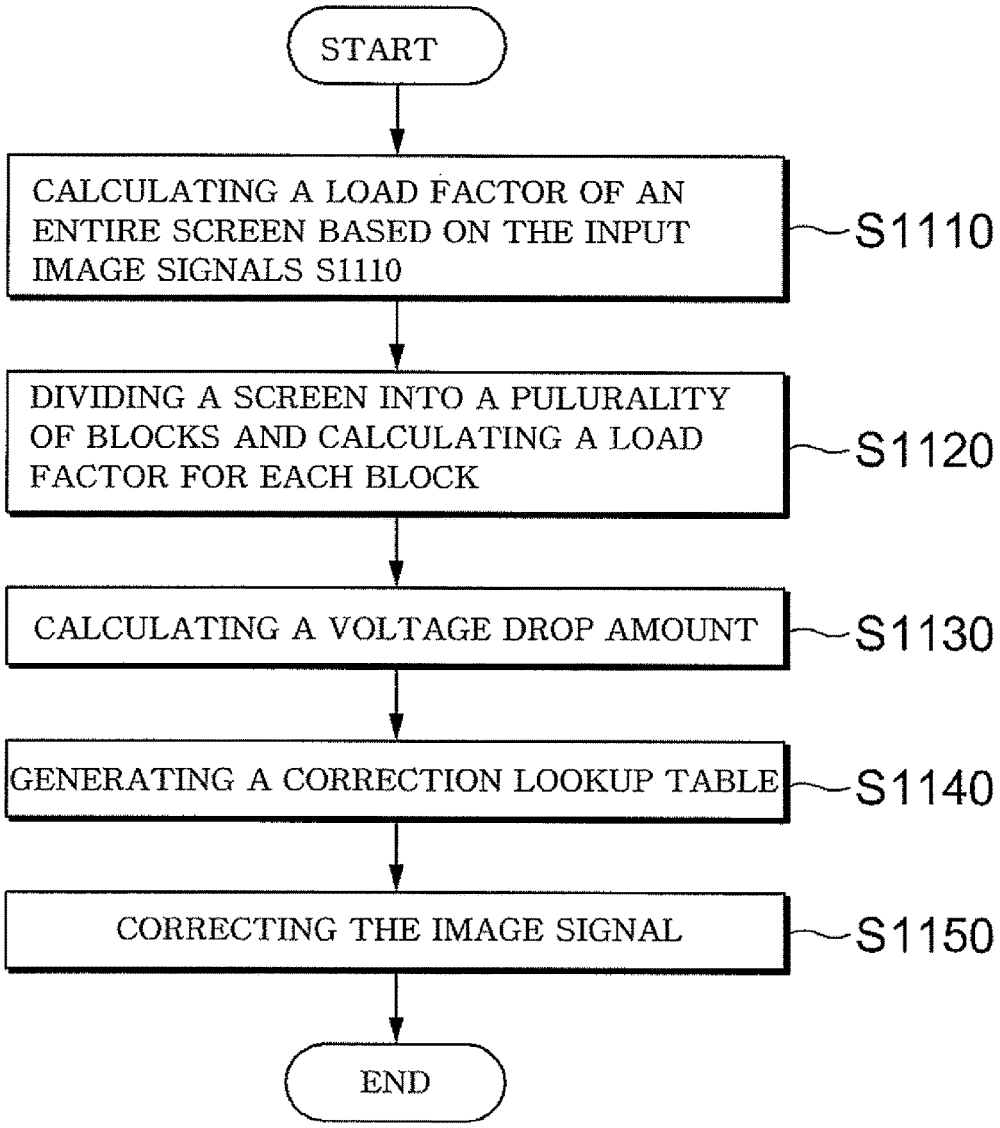
FIG. 9 is a flow chart illustrating a method of correcting image signals according to an embodiment of the present invention.

FIG. 9 is a flow chart illustrating a method of correcting image signals according to an embodiment of the present invention.

In S1110, the frame load calculating unit 122 calculates a load factor of an entire screen based on the image signals supplied from the outside. Further, the expected current consumption may be calculated based on the calculated load factor.

In S1120, the horizontal block load calculating unit 123 divides the display panel into a plurality of horizontal blocks with respect to a plurality of scan lines, and calculates a load factor of each horizontal block. Further, power consumption of each horizontal block can be calculated based on the total expected current consumption of the panel and the load factor of each horizontal block.

In S1130, the voltage drop amount calculating unit 124 may calculate an amount of voltage drop based on the power consumption of each horizontal block and resistance of the power lines.

In S1140, the V_LUT generating unit 125 may generate a voltage drop correction lookup table based on the amount of voltage drops of the plurality of horizontal blocks. Further, the V_LUT generating unit 125 may generate more output data than the input data by using data interpolation based on the amount of voltage drops of the plurality of horizontal blocks. For example, the number of the input voltage drop amounts of the horizontal blocks may correspond to the number of blocks formed in S1120, and the number of the output voltage drop correction lookup tables may correspond to the number of scan lines of the display panel.

In S1150, the image signal correcting unit 126 may correct the input image signal in accordance with the voltage drop correction lookup table.

In FIG. 9, S1120 is described as being performed after S1110. However, the present invention is not limited thereto, and thus, each of S1110 and S1120 may be performed independently. Further, S1110 may be performed after S1120.

Figure 10:
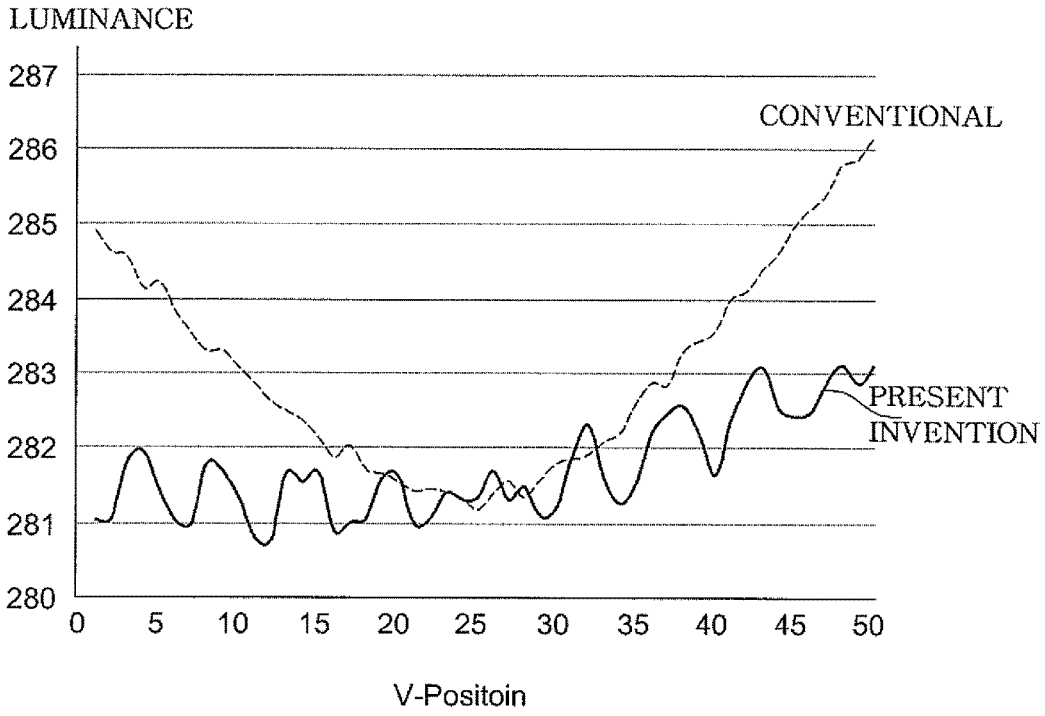
FIG. 10 is a graph illustrating a luminance variation of a panel according to an embodiment of the present invention.

FIG. 10 is a graph illustrating luminance variations of a panel according to an embodiment of the present invention.

In more detail, FIG. 10 illustrates measured luminance of a box pattern displayed at the center area of the panel, provided that a load pattern is moved in a vertical direction of the panel.

Referring to FIG. 10, a dashed line represents a case where the existing correction method is applied. In this case, the luminance of the box pattern at the center area exhibits a substantial luminance variation depending on the vertical location of the load pattern.

On the contrary, a solid line in FIG. 10 represents a case where a method of an embodiment of the present invention is applied. In this case, the luminance of the box pattern does not exhibit a noticeable luminance variation.

From the foregoing, it will be appreciated by those skilled in the art that various embodiments of the present invention have been described herein for purposes of illustration, and that various modifications may be made without departing from the scope and spirit of the present invention. Accordingly, the various embodiments disclosed herein are not intended to be limiting, with the scope and spirit of the present invention being indicated by the following claims, and equivalents thereof.

What is claimed is:

1. An organic light emitting display device comprising:

a display panel comprising a plurality of pixels;

a controller configured to correct input image signals supplied from the outside according to an amount of voltage drop, and to output the corrected input image signals, the controller comprising:

a load factor calculator configured to calculate a load factor of a panel based on the input image signals;

a horizontal block load factor calculator configured to calculate a driving current of each of a plurality of horizontal blocks formed by dividing the panel according to a plurality of scan lines;

a voltage drop amount calculator configured to calculate the amount of the voltage drop of each of the horizontal blocks based on the driving current of each of the horizontal blocks; and a lookup table generator configured to generate a voltage drop correction lookup table based on the amount of the voltage drop for each of the horizontal blocks and deviation of the voltage drop between the horizontal blocks;

a data driver configured to supply data signals corresponding to the corrected input image signals to data lines coupled to the pixels; and a scan driver configured to supply scan signals in synchronization with the data signals to the scan lines coupled to the pixels, wherein the lookup table generator is configured to generate correction data according to the amount of the voltage drop of each of the horizontal blocks, wherein the lookup table generator is configured to adjust the correction data corresponding to each of the horizontal blocks according to a pattern of the input image signals, wherein the lookup table generator is configured to generate gain correction values corresponding to each scan line by using data interpolation based on the correction data of each of the horizontal blocks, and wherein the voltage drop correction lookup table comprises the gain correction values.

2. The organic light emitting display device of claim 1, wherein the horizontal block load factor calculator is configured to calculate image signal load factors of the plurality of horizontal blocks based on the input image signals.

3. The organic light emitting display device of claim 2, wherein the voltage drop amount calculator is configured to calculate the amount of the voltage drop of the horizontal blocks based on the driving current and a line resistance of the panel.

4. The organic light emitting display device of claim 3, wherein the lookup table generator is configured to generate the voltage drop correction lookup table based on the amount of the voltage drop of the horizontal blocks.

5. The organic light emitting display device of claim 1, wherein the controller further comprises an image signal corrector configured to correct the input image signals by multiplying the gain correction values of the voltage drop correction lookup table.

6. The organic light emitting display device of claim 1, wherein the voltage drop amount calculator is configured to calculate the amount of the voltage drop of the horizontal blocks based on the driving current and a line resistance of the panel.

7. The organic light emitting display device of claim 6, wherein the lookup table generator is configured to generate the voltage drop correction lookup table based on the amount of the voltage drop of the horizontal blocks.

8. The organic light emitting display device of claim 7, wherein the voltage drop correction lookup table comprises gain correction values of the display panel based on the amount of the voltage drop of the plurality of horizontal blocks.

9. The organic light emitting display device of claim 8, wherein the gain correction values of the display panel are assigned for each scan line.

10. The organic light emitting display device of claim 9, wherein the controller further comprises an image signal corrector configured to correct the input image signals by multiplying the gain correction values of the voltage drop correction lookup table.

11. The organic light emitting display device of claim 1, wherein the controller further comprises an image signal corrector configured to correct the input image signals by multiplying gain correction values of the voltage drop correction lookup table.

12. A method of driving an organic light emitting display device, the method comprising:

calculating image signal load factors of a plurality of horizontal blocks based on input image signals;

calculating driving currents of the horizontal blocks based on the image signal load factors of the horizontal blocks;

calculating voltage drop amounts of the horizontal blocks based on the driving currents of each of the horizontal blocks;

calculating correction data for correcting the input image signals based on the voltage drop amounts of the horizontal blocks;

generating gain correction values corresponding to each scan line through data interpolation based on the correction data of each of the horizontal blocks; and correcting the input image signals based on the gain correction values, wherein the correction data are adjusted according to a pattern of the input image signals.

13. The method of claim 12, wherein the gain correction values are updated for the input image signals on a frame-by-frame basis.

14. The method of claim 12, wherein gain correction values are assigned for each scan line.

15. The method of claim 12, the method further comprising generating a voltage drop correction lookup table based on the voltage drop amounts of the horizontal blocks.

16. The method of claim 12, the method further comprising calculating a load factor of an entire panel based on the input image signals.

17. The organic light emitting display device of claim 1, wherein the data interpolation comprises linear interpolation, polynomial interpolation, or spline interpolation.

18. The method of claim 12, wherein the data interpolation comprises linear interpolation, polynomial interpolation, or spline interpolation.

* * * * *